US008173575B2

(12) United States Patent
Roth et al.

(10) Patent No.: US 8,173,575 B2
(45) Date of Patent: May 8, 2012

(54) DUAL-SIDED THERMAL FORM CARD

(75) Inventors: Joseph D Roth, Springboro, OH (US); Paul C Blank, La Crosse, WI (US); Wendell B Halbrook, Waynesville, OH (US)

(73) Assignee: NCR Corporation, Duluth, GA (US)

( * ) Notice: Subject to any disclaimer, the term of this patent is extended or adjusted under 35 U.S.C. 154(b) by 1111 days.

(21) Appl. No.: 11/703,899

(22) Filed: Feb. 8, 2007

(65) Prior Publication Data

US 2007/0212515 A1 Sep. 13, 2007

Related U.S. Application Data

(60) Provisional application No. 60/779,781, filed on Mar. 7, 2006, provisional application No. 60/779,782, filed on Mar. 7, 2006.

(51) Int. Cl.
*B41M 5/30* (2006.01)

(52) U.S. Cl. ..... 503/226; 503/204; 503/206

(58) Field of Classification Search ..... None
See application file for complete search history.

(56) References Cited

U.S. PATENT DOCUMENTS

| | | | |
|---|---|---|---|
| 3,947,854 | A | 3/1976 | Hansen et al. |
| 4,167,392 | A | 9/1979 | Defago |
| RE30,116 | E | 10/1979 | Maalouf |
| 4,309,255 | A | 1/1982 | Gendler et al. |
| 4,507,669 | A | 3/1985 | Sakamoto et al. |
| 4,708,500 | A | 11/1987 | Bangs et al. |
| 4,956,251 | A | 9/1990 | Washizu et al. |
| 4,965,166 | A | 10/1990 | Hosoi et al. |
| 5,055,373 | A | 10/1991 | Saeki et al. |
| 5,101,222 | A | 3/1992 | Hakkaku |
| 5,132,704 | A | 7/1992 | Nakagawa |
| 5,196,297 | A | 3/1993 | Dombrowski, Jr. et al. |
| 5,214,750 | A | 5/1993 | Minowa et al. |
| 5,266,550 | A | 11/1993 | Asajima et al. |
| 5,284,816 | A | 2/1994 | Stephenson |
| 5,398,305 | A | 3/1995 | Yawata et al. |
| 5,428,714 | A | 6/1995 | Yawata et al. |

(Continued)

FOREIGN PATENT DOCUMENTS

EP 0947340 10/1999

(Continued)

OTHER PUBLICATIONS

JP Abstract, vol. 007,No. 063 (M-200), Mar. 16, 1983 & JP 57-208298 A (Ricoh KK), Dec. 21, 1982.

(Continued)

*Primary Examiner* — Bruce H Hess
(74) *Attorney, Agent, or Firm* — Joseph Merhle/Schwegmen

(57) ABSTRACT

A dual-sided thermal form-card and method for manufacturing are provided. In an embodiment, the dual-sided thermal form card includes a dual-sided thermal form including a first side and a second side, and a dual-sided thermal card including a first side and a second side being integral with the form and detachable therefrom, wherein the form and the card are adapted to be thermally imaged from respective first and second sides thereof. In an embodiment, the method of manufacturing a dual-sided thermal form-card includes providing dual-sided thermal medium including a first side and a second side, and perforating or die cutting the dual-sided thermal medium to produce a form and a card integral to the form, wherein the form and the card are adapted to be thermally imaged from the first side and the second side.

13 Claims, 9 Drawing Sheets

U.S. PATENT DOCUMENTS

| | | | |
|---|---|---|---|
| 5,437,004 | A | 7/1995 | Miyasaka et al. |
| 5,555,349 | A | 9/1996 | Miyasaka et al. |
| 5,584,590 | A | 12/1996 | Ito et al. |
| 5,594,653 | A | 1/1997 | Akiyama et al. |
| 5,629,259 | A | 5/1997 | Akada et al. |
| 5,639,169 | A | 6/1997 | Aruga |
| 5,677,722 | A | 10/1997 | Park |
| 5,692,110 | A | 11/1997 | Miyasaka et al. |
| 5,707,925 | A | 1/1998 | Akada et al. |
| 5,710,094 | A | 1/1998 | Minami et al. |
| 5,755,521 | A | 5/1998 | Ito et al. |
| 5,756,188 | A | 5/1998 | Reiter et al. |
| 5,763,356 | A | 6/1998 | Ueno et al. |
| 5,789,340 | A | 8/1998 | Brust et al. |
| 5,792,725 | A | 8/1998 | Simpson et al. |
| 5,794,530 | A | 8/1998 | Dobashi et al. |
| 5,800,081 | A | 9/1998 | Teradaira et al. |
| 5,815,191 | A | 9/1998 | Michielsen et al. |
| 5,846,900 | A | 12/1998 | Reiter et al. |
| 5,876,836 | A | 3/1999 | Imamura et al. |
| 5,883,043 | A | 3/1999 | Halbrook, Jr. et al. |
| 5,886,725 | A | 3/1999 | Miyadera et al. |
| 5,918,910 | A | 7/1999 | Stillwagon et al. |
| 5,964,541 | A | 10/1999 | Murison et al. |
| 6,095,414 | A | 8/2000 | Long et al. |
| 6,130,185 | A | 10/2000 | Narita et al. |
| 6,150,067 | A | 11/2000 | Koike et al. |
| 6,210,777 | B1 | 4/2001 | Vermeulen et al. |
| 6,388,692 | B1 | 5/2002 | Iwata et al. |
| 6,562,755 | B1 | 5/2003 | Halbrook, Jr. et al. |

FOREIGN PATENT DOCUMENTS

| | | |
|---|---|---|
| GB | 2 250 478 | 6/1992 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 61-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

DUAL-SIDED THERMAL FORM CARD

CROSS REFERENCE TO RELATED APPLICATIONS

This application claims priority to U.S. Provisional Application No. 60/779,781 entitled "Two-Sided Thermal Printing" and filed on Mar. 7, 2006, and U.S. Provisional Application No. 60/779,782 entitled "Dual-Sided Thermal Printer" and filed on Mar. 7, 2006; the disclosures of which are hereby incorporated by reference herein.

TECHNICAL FIELD

This disclosure relates to dual sided thermal media. More particularly, this disclosure is directed to dual-sided thermal form-cards.

BACKGROUND

In many industries and applications there has been a shift away from printing documents on bond paper toward printing documents on direct thermal paper (e.g., thermal media).

A particular type of a document is a form-card which combines the benefits of a form, such as a letter and the like, with the benefits of a card, such as coupon and the like. Generally, the form-card document is generated in such a way that the card may be detached easily from the form and used independently. For example, the form-card document may be a letter from an insurance company enclosing a vehicle insurance card that may be easily detached from the letter. The card may be an integral part of the form-card document or may be adhered to the form-card document, with respective mechanisms for securing the card to and detaching the card from the form.

The form-card document may be pre-reprinted with general-type information, such as logos and decorative artwork. Variable information, which may include recipient name and address, identification number and the like, may then be printed on the form-card document. Typically, conventional form-card documents are generated from bond paper and are printed with variable information using laser jet or inkjet printers. Once finalized, the form-card documents are delivered to the recipients that may be identified by the variable information.

Single-sided direct thermal printers have been used extensively to image thermal media such as receipts. In single-sided thermal printing, information is printed or imaged only on one side of the document. Dual-sided direct thermal printing of documents, described in U.S. Pat. Nos. 6,784,906 and 6,759,366, is however, fairly new. In dual-sided direct thermal printing, a thermal printer is configured to allow concurrent printing on both sides of a thermal media moving along a feed path through the thermal printer. In such a printer, a direct thermal print head is disposed on each side of the thermal media along the feed path. In operation, each thermal print head faces an opposing platen across the thermal media from the respective print head. During printing, the opposing print heads selectively apply heat to the opposing sides of dual-sided thermal media, comprising a substrate with a thermally sensitive coating on each of the opposing surfaces of the substrate. The coating changes color when heat is applied, such that printing is provided on the coated substrate.

As the application of dual-sided direct thermal printing technology permeates into and gains acceptance in various industries and applications, it would be advantageous to provide a dual-sided thermal form-card document capable of being imaged using a dual-sided direct thermal printer.

SUMMARY

In accordance with an embodiment, there is provided a form-card comprising: a dual-sided thermal form including a first side and a second side; and a dual-sided thermal card being integral with the form and detachable therefrom, herein the form and the card are adapted to be thermally imaged from a first side and a second side.

In accordance with another embodiment, there is provided a form-card comprising: a dual-sided thermal form including a first side and a second side; and a single-sided thermal patch adhered to a first side of the form, the thermal patch including a single-sided thermal card that is integral therewith and being detachable therefrom, wherein the form is adapted to be imaged from the first side and the second side and the card is adapted to be imaged from the first side system for.

In accordance with a further embodiment, there is provided a method of manufacturing a dual-sided thermal form-card, the method comprising: providing dual-sided thermal medium including a first side and a second side; and perforating or die cutting the dual-sided thermal medium to produce a form and a card integral to the form, wherein the form and the card are adapted to be thermally imaged from the first side and the second side.

In accordance with yet another embodiment, there is provided a method of manufacturing a dual-sided thermal form-card, the method comprising: providing dual-sided thermal medium including a first side and a second side; and adhering a single-sided thermal patch to a first side of the medium, the thermal patch including a single-sided thermal card being integral therewith and being detachable therefrom, wherein the medium is adapted to be thermally imaged from the first side and the second side and the card is adapted to be thermally imaged from the first side.

BRIEF DESCRIPTION OF THE DRAWINGS

Various features and attendant advantages of the example embodiments will be more fully appreciated as the same becomes better understood when considered in conjunction with the accompanying drawings, in which like reference characters designate the same or similar parts throughout the several views, and wherein.

DETAILED DESCRIPTION

Figure 1:
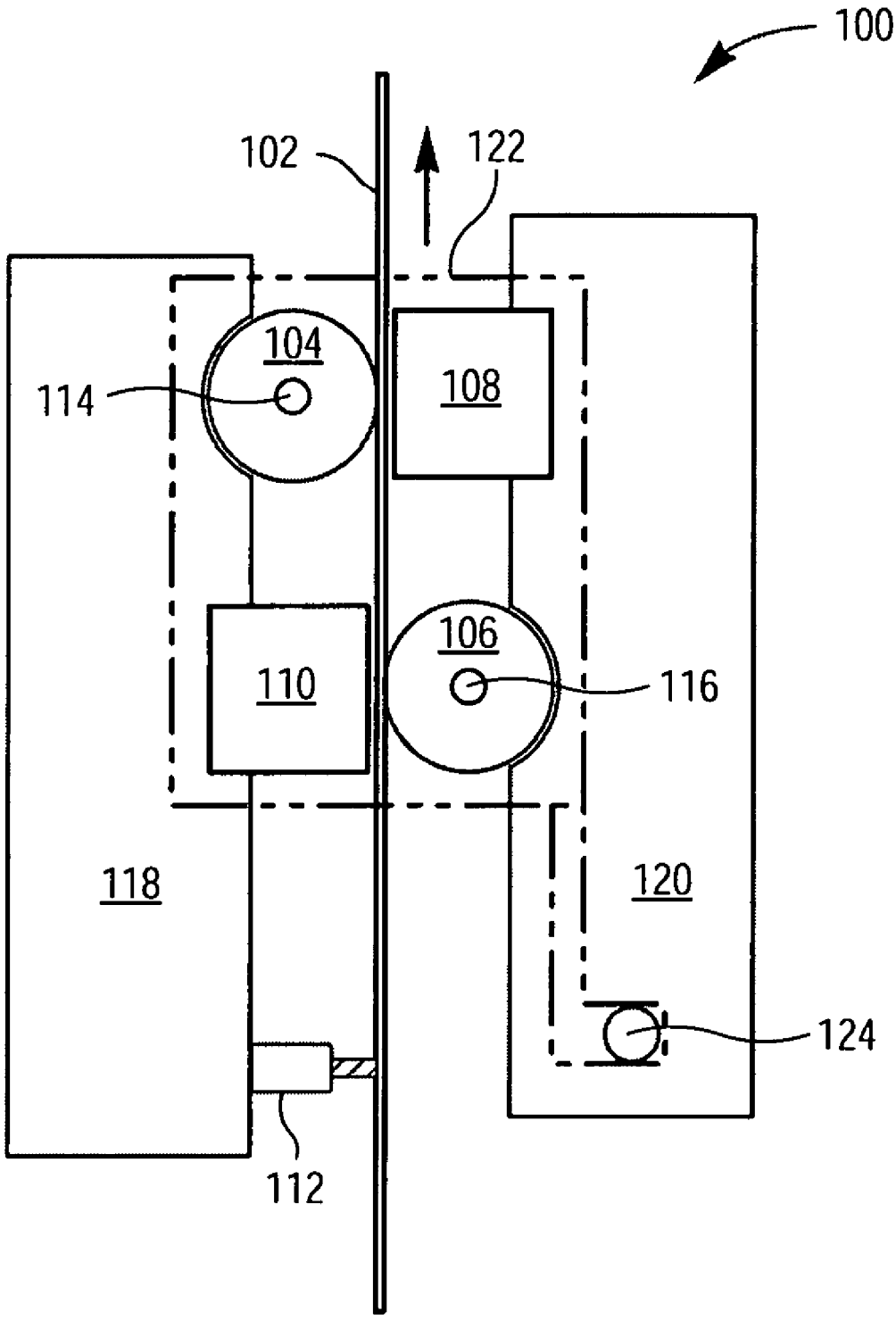
FIG. 1 illustrates a schematic of an example dual-sided imaging direct thermal printer useable for dual-sided imaging of thermal print media, such as form-card documents.

FIG. 1 illustrates a schematic of an example dual-sided imaging direct thermal printer 100 useable for dual-sided imaging of thermal print media 102, such as form-card documents, examples of which will be described in greater detail below with reference to FIGS. 2A-6E. It is to be noted that printer 100 may also print a variety of other documents such as receipts, tickets, gift certificates, sweepstakes, coupons, vouchers, as well as many other documents not enumerated herein. Thermal printer 100 includes first and second support arms 118 and 120. Second support arm 120 may be journaled on an arm shaft 124 to permit second support arm 120 to pivot or rotate in relation to first support arm 118. The support arms 118 and 120 may also be in a fixed relation to one another.

Further with reference to FIG. 1, thermal printer 100 further includes platens 104 and 106 and opposing thermal print heads 108 and 110 on opposite sides of the thermal print media 102. More specifically, first support arm 118 includes a first platen 104 and a first print head 110, and the second support arm 120 includes a second platen 106 and a second print head 108. The platens 104 and 106 are substantially cylindrical in shape, although other shapes such as flat plates may be provided. The first platen 104 may be journaled on a first shaft 114 and the second platen 106 may be journaled on a second shaft 116. Each of shafts 114 and 116 are coupled to the support arms 118 and 120, respectively. Platens 104 and 106 are further rotatable via drive assembly 122 about shafts 114 and 116, respectively, for moving thermal print media 102 through the thermal printer 100. The drive assembly 122 comprises a motor (not shown) for powering a system of gears, links, cams, and combinations thereof. The first and second print heads 108 and 110 may be any print heads suitable for direct thermal printing, such as those disclosed in U.S. Pat. Nos. 3,947,854, 4,708,500 and 5,964,541. Thermal printer 100 further includes one or more sensors 112 for determining various conditions to control the operation of the thermal printer 100, such as one or more media quantity sensors to detect a paper out condition, and/or one or more media type sensors to detect a type of media (e.g., single-sided thermal, double-sided thermal or non-thermal) in the printer 100.

Still further with reference to FIG. 1, thermal printer 100 print on thermal print media 102, which may be supplied in the form of a continuous paper roll, a continuous fan-folded stack or cut sheet stock. In operation, images comprising graphics or text, and combinations thereof, may be printed on one or both sides thereof, to provide the printed document, such as for example, a form-card document. As noted above, different examples of the form-card documents will be described in greater detail with reference to FIGS. 2A-6E below.

Dual-sided direct thermal printing may be facilitated by, for example, thermal print media 102, which includes dyes on opposite sides of the print media 102, and a sufficiently thermally resistant substrate that inhibits thermal printing on one side of the print media 102 from affecting thermal printing on the opposite side of print media 102. Thermal print media 102 (including form and/or card of the form-card document) may be a double-sided thermal paper, e.g., comprising a cellulosic or polymer substrate sheet coated on each side with thermally imageable coatings as described in U.S. Pat. Nos. 6,784,906 and 6,759,366, the contents of which are incorporated by reference herein. It is noted in the example embodiments illustrated in FIGS. 2A-6E below, it is possible that, in addition to the above described double-sided thermal paper, the card of the form-card document may comprise a single-sided thermal paper having a cellulosic or polymer substrate sheet coated with heat thermally imageable coatings on one side only.

With further reference to FIG. 1, dual-sided direct thermal printing of the print media 102 may be accomplished in a single pass process. Alternately, dual-sided direct thermal printing may be accomplished in a process where the media 102 may be imaged by one or both of the thermal print heads 108 and 110 when moving in a first direction, and then retracted for further imaging by the one or both thermal print heads 108 and 110 with the media moving in either the first or the second, retract direction. Once printing is completed, the print media 102 may be manually or automatically cut or detached to form a printed form-card document, examples of which are described in greater detail below with reference to FIGS. 2A-6E.

Figure 2A:
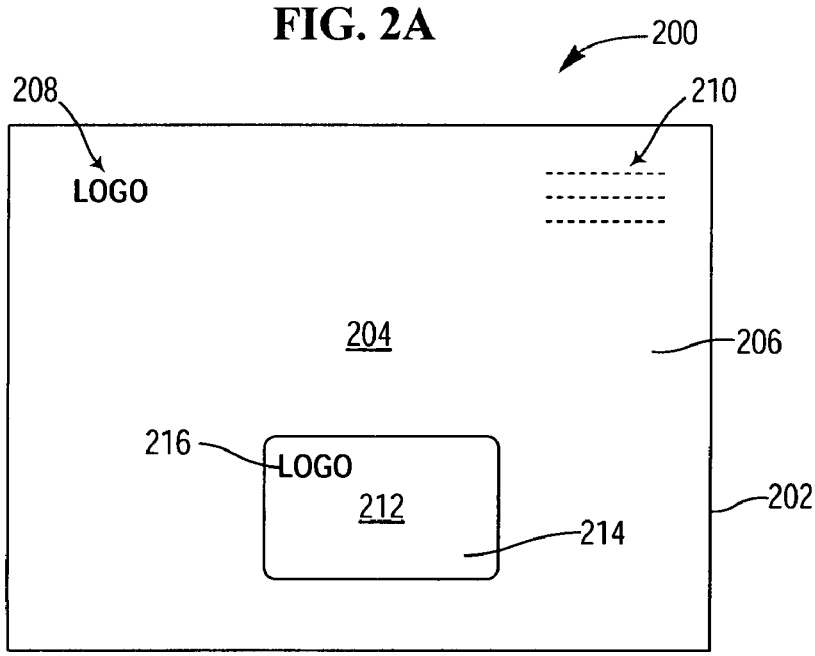
FIG. 2A illustrates an example first side of a form-card document that may be imaged using the example dual-sided imaging direct thermal printer in accordance with a first embodiment.

FIG. 2A illustrates an example first side 200 of a form-card document 202 that may be imaged using the example dual-sided imaging direct thermal printer 100 in accordance with a first embodiment. The form-card document 202 includes a form 204 and a card 212. As described hereinabove with reference to FIG. 1, thermal print media 102 may include multiple form-card documents 202, which may be supplied in a continuous thermal print media roll, a continuous fan-folded stack, or precut form-card sheet stock. The form 204 includes a printing surface 206 on the first side 200 of the form-card document 202 for imaging graphics, text and/or combinations thereof via the dual-sided imaging direct thermal printer 100 of FIG. 1. The printing surface 206 may further include pre-printed subject matter, including a logo 208 and other information 210, both of which may be disposed at predetermined locations of the form 204, as may be desired. The pre-printed subject matter 208, 210 may include decorative artwork and typical information that may be provided on the form-cards, such a business name, address, telephone numbers, advertisement and the like. The preprinting may be achieved via a media converting process, which may print logo 208 and other information 210 on the printing surface 206 of the form 204. The media converting process may utilize a printing press to print the aforementioned subject matter on the form-card document. The printing press may employ lithographic, ultra violet lithographic, or flexographic printing. Other printing methods, such as the gravure method, may also be employed in the media converting process. Alternatively, the logo 208 and/or other information 210 may be imaged on the printing surface 206 via the dual-sided imaging direct thermal printer 100 of FIG. 1.

Further with reference to FIG. 2A, the card 212 of the form-card document 202 also includes a printing surface 214 for imaging graphics, text and/or combinations thereof via the dual-sided imaging direct thermal printer 100 of FIG. 1. More specifically, the printing surface 214 of the card 212 may be imaged by the direct thermal printer 100 illustrated in FIG. 1. The imaged information may include variable information, which may include information identifying the recipient or user of the card 212, such as by name and address, identification number and the like. The printing surface 214 of the card 212 may also include pre-printed subject matter, including a logo 216 as well as any other information, which may be disposed at predetermined locations on the card 212. The pre-printed subject matter on surface 214 of the card 212 may include information similar to that provided on surface 206 of the form 204, e.g., business name, address, telephone numbers, advertisement and the like. The preprinting may be achieved via a media converting process described above. The preprinting of printing surfaces 206, 214 may be accomplished via one or more converting processes. As will be described in greater detail below, the card 212 is integral to the form 204, e.g., card 212 being formed from the form 204 via die cuts.

Figure 2B:
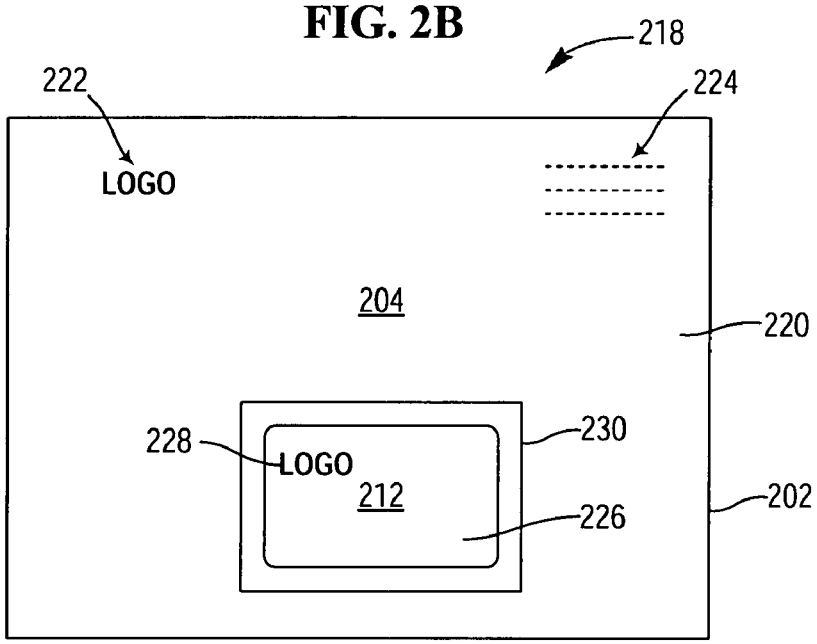
FIG. 2B illustrates an example second side of the form-card document in accordance with the first embodiment.

FIG. 2B illustrates an example second side 218 of the form-card document 202 in accordance with the first embodiment. The form 204 also includes a printing surface 220 on the opposite second side 218 of the form-card document 202 for imaging graphics, text and/or combinations thereof. The printing surface 220 may also be imaged by the direct thermal printer 100 illustrated in FIG. 1. Just like the printing surface 206 of the first side 200, the printing surface 220 of the second side 218 may also include pre-printed subject matter, including a logo 222 and other information 224, which may be disposed at predetermined locations of the form 204, as may be desired. The pre-printed subject matter 222, 224 may also include decorative artwork and typical information that may be provided on the form-card documents, such a business name, address, telephone numbers, advertisement and the like. The preprinting may be achieved via a media converting process as described above in reference to FIG. 2A.

Further with reference to FIG. 2B, the card 212 on the second side 218 of the form-card 202 provides a printing surface 226 for imaging graphics, text and/or combinations thereof via the dual-sided imaging direct thermal printer 100 of FIG. 1. The second side 218 of the form-card 202 may also include a coating 230, which may include multiple layers and be disposed atop of and encompass the card 212 to protect the printing surface 226 from possible mechanical defacing, such as by scratching, tearing, crumpling, writing and the like, through ordinary use of the card 212 by a user. The coating 230 may be a sufficiently thin single-layer laminate material (e.g., clear or opaque), which may allow an adequate amount of heat to penetrate to the printing surface 226 to facilitate imaging via the direct thermal printer 100 of FIG. 1. The laminate material may include polyester, polyethylene, polypropylene and the like. The layers of the coating 230 and the application of the coating 230 to printing surface 220 will be described in greater detail below with reference to FIG. 2C.

Still further with reference to FIG. 2B, the printing surface 226 of the card 212 may be imaged through the coating 230 by the direct thermal printer 100 illustrated in FIG. 1. The imaged information may also include variable information, which may include information identifying the recipient or user of the card 212, such as name and address, identification number and the like. The printing surface 226 of the card 212 may also include pre-printed subject matter, including a logo 228 as well as any other information, which may be disposed at predetermined locations on the card 212. The pre-printed subject matter on surface 226 of the card 212 may include information similar to that provided on the form 204, e.g., business name, address, telephone numbers, advertisement and the like. The preprinting of printing surfaces 220, 226 may be accomplished via one or more converting processes as described above.

Figure 2C:
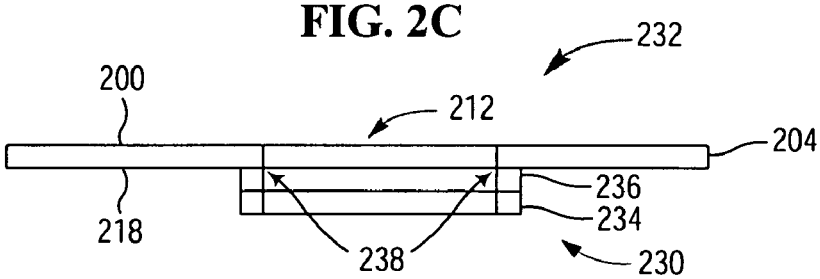
FIG. 2C illustrates an example cross-section of the example form-card document illustrated in FIGS. 2A-2B in accordance with the first embodiment.

FIG. 2C illustrates an example cross-section 232 of the example form-card document 202 illustrated in FIGS. 2A-2B above in accordance with the first embodiment. The coating 230 includes a laminate layer 234 adhered to the second side 218 of the form 204 via an adhesive layer 236. The adhesive layer 236 that adheres the laminate layer 234 to the form 204 may use a hot melt adhesive process, a water-based adhesive process, a solvent-based adhesive process, a warm melt adhesive process that is cured via ultraviolet light, and the like. Where heat is used, it is important to mitigate the amount of heat that the foregoing adhesive processes may produce to avoid unintended imaging of the form 204 and/or the card 212. This may be achieved by limiting the duration of time a heated adhesive layer 236 is in contact with the form 204 and the card 212. This may also be accomplished by using an adhesive layer 236 that require less heat, such as via a warm melt adhesive process. Alternatively, or in addition, a roller (FIG. 8, element 840) that is chilled may be used to remove heat, preventing imaging during the adhesive process.

Further with reference to FIG. 2C, after the laminate layer 234 is adhered via adhesive layer 236, perforations 238 are provided through form 204, adhesive layer 236 and the laminate layer 234 to form the card 212 illustrated in FIGS. 2A-2B above. It is noted that the perforations 238 may be provided using die cutting techniques. An example die cutting technique may involve pressing a cutting mechanism, which has plural cutting surfaces separated by skips, through the form 204, adhesive layer 236 and the laminate layer 234 to make intermittent cuts (perforations) 238, forming the card 212. It should be noted that, where used, intermittent cuts may be provided in a piecewise fashion across a printing surface 206, 220 of the form-card 202, through the depth or thickness of the form-card 202 (e.g., perpendicular to a printing surface 206, 220 of the form-card 202), or combinations of the two.

Figure 3A:
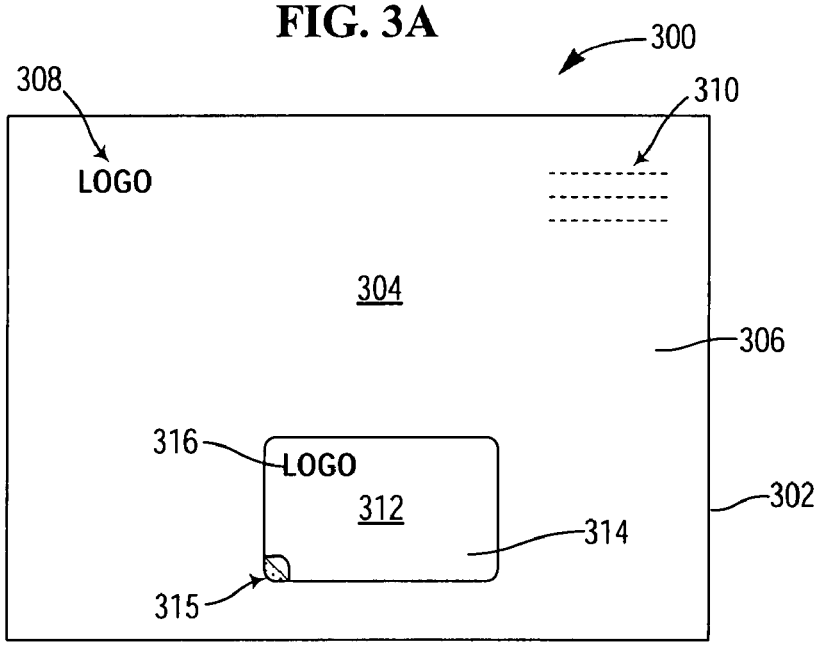
FIG. 3A illustrates an example first side of a form-card document that may be imaged using the example dual-sided imaging direct thermal printer in accordance with a second embodiment.

FIG. 3A illustrates an example first side 300 of a form-card document 302 that may be imaged using the example dual-sided imaging direct thermal printer 100 in accordance with a second embodiment. The form-card document 302 includes a form 304 and a card 312. The form 304 includes a printing surface 306 on the first side 300 of the form-card document 302 for imaging graphics, text and/or combinations thereof via the dual-sided imaging direct thermal printer 100 of FIG. 1. The printing surface 306 may further include pre-printed subject matter, including a logo 308 and other information 310. The card 312 also includes a printing surface 314 for imaging graphics, text and/or combinations thereof via the dual-sided imaging direct thermal printer 100 of FIG. 1. The printing surface 314 of the card 312 may also include pre-printed subject matter, including a logo 316 as well as any other information. Elements 304-316 (except 315) of form-card 302 are analogous to elements 204-216 of form-card 202 of FIG. 2A and therefore elements 304-316 will not be described in detail; instead the description of the analogous elements 204-216 is incorporated herein. As illustrated at 315 in FIG. 3A, the card 312 may also be adhered or secured to the form 304 by a clean release layer that would allow the user to easily separate the card 312 from the form 304, as will be described in greater detail below in reference to FIG. 3C.

Figure 3B:
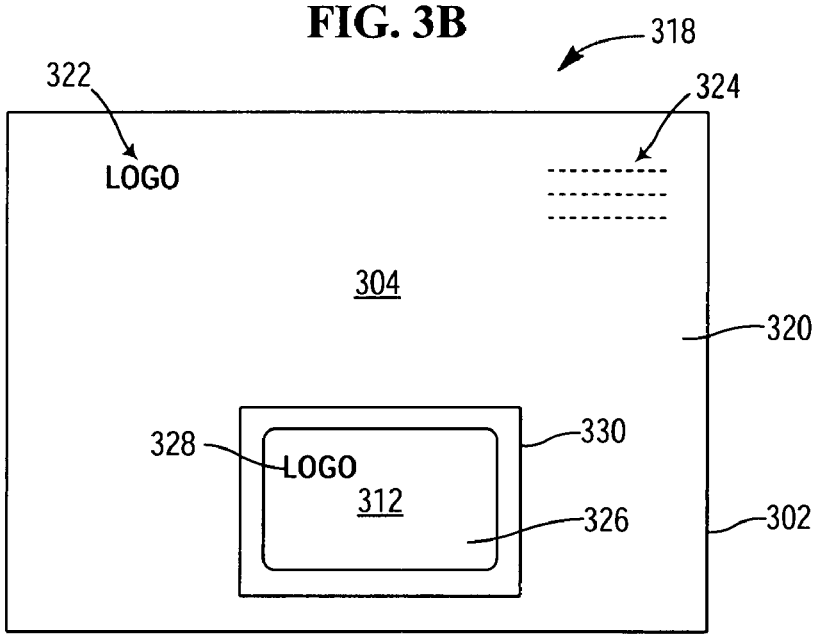
FIG. 3B illustrates an example second side of the form-card document in accordance with the second embodiment.

FIG. 3B illustrates an example second side 318 of the form-card document 302 in accordance with the second embodiment. The form 304 also includes a printing surface 320 on the second side 318 of the form-card document 302 for imaging graphics, text and/or combinations thereof. The printing surface 320 may also include pre-printed subject matter, including a logo 322 and other information 324, which may be disposed at predetermined locations of the form 304, as may be desired. The card 312 also includes a printing surface 326 on the second side 318 of the form-card document 302 for imaging graphics, text and/or combinations thereof. The printing surface 326 of the card 312 may also include pre-printed subject matter, including a logo 328 as well as any other information, which may be disposed at predetermined locations on the card 312. The second side 318 of the form-card 302 may also include a coating 330, which may include multiple layers and be disposed atop of and encompass the card 312 to protect the printing surface 326 from possible mechanical defacing, allow imaging of the printing surface 326 via the direct thermal printer 100 of FIG. 1, and allow easy separation of the card 312 from the form 304. Elements 320-328 of form-card 302 are analogous to elements 220-228 of form-card 202 of FIG. 2B and therefore elements 320-328 will not be described in detail; instead the description of the analogous elements 220-228 is incorporated herein. The particular layers of the example coating 330 will be described in greater detail below with reference to FIG. 3C.

Figure 3C:
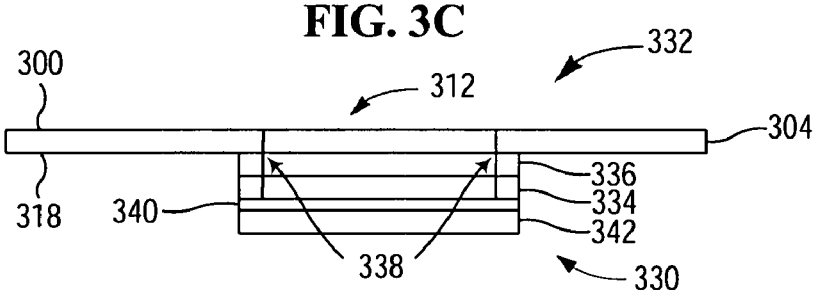
FIG. 3C illustrates an example cross-section of the example form-card document illustrated in FIGS. 3A-3B in accordance with the second embodiment.

FIG. 3C illustrates an example cross-section 332 of the example form-card document 302 illustrated in FIGS. 3A-3B above in accordance with the second embodiment. The coating 330 includes a first laminate layer 334 adhered to the second side 318 of the form 304 via an adhesive layer 336. The first laminate layer 334 and the adhesive layer 336 of form-card 302 are analogous to respective layers 234, 236 of form-card 202 of FIG. 2C and therefore elements 334, 336 will not be described in detail; instead the description of the analogous elements 234, 236 is incorporated herein. In addition, a second laminate layer 342 is adhered via a clean release layer 340 to the first laminate layer 334, allowing a user to easily separate the card 312 from the form 304. Perforations 338 (analogous to perforation 228) may be provided through form 304, adhesive layer 336 and the first laminate layer 334 to form the card 312 illustrated in FIGS. 3A-3B above. Alternatively to the perforations 338, a complete die cut slit may be provided around card 312, as the clean release layer 340 provides sufficient adhesion of the first laminate layer 334 to the second laminate layer 342.

Figure 4A:
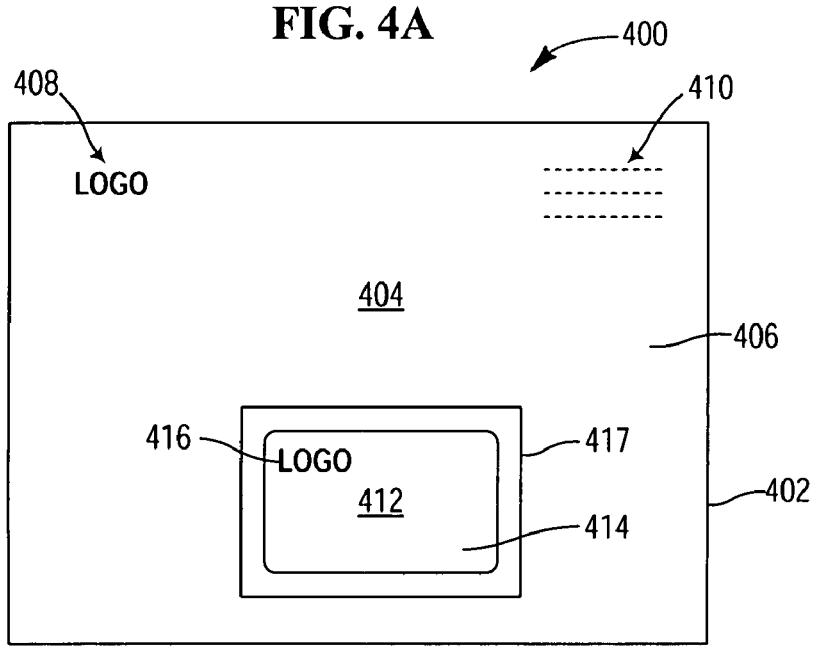
FIG. 4A illustrates an example first side of a form-card document that may be imaged using the example dual-sided imaging direct thermal printer in accordance with a third embodiment.

FIG. 4A illustrates an example first side 400 of a form-card document 402 that may be imaged using the example dual-sided imaging direct thermal printer 100 in accordance with a third embodiment. The form-card document 402 includes a form 404 and a card 412. The form 404 includes a printing surface 406 on the first side 400 of the form-card document 402 for imaging graphics, text and/or combinations thereof via the dual-sided imaging direct thermal printer 100 of FIG. 1. The printing surface 406 may further include pre-printed subject matter, including a logo 408 and other information 410. The card 412 also includes a printing surface 414 for imaging graphics, text and/or combinations thereof via the dual-sided imaging direct thermal printer 100 of FIG. 1. The printing surface 414 of the card 412 may also include pre-printed subject matter, including a logo 416 as well as any other information. Elements 404-416 of form-card 402 are analogous to elements 204-216 of form-card 202 of FIG. 2A and therefore elements 404-416 will not be described in detail; instead the description of the analogous elements 204-216 is incorporated herein.

Further with reference to FIG. 4A, the first side 400 of the form-card 402 may also include a coating 417, which may include multiple layers and be disposed atop of and encompass the card 412 to protect the printing surface 416 from possible mechanical defacing, such as by scratching, tearing, crumpling, writing and the like, through ordinary use of the card 412 by a user. The coating 417 may be a sufficiently thin single-layer laminate material (e.g., clear or opaque), which may allow an adequate amount of heat to penetrate to the printing surface 416 to facilitate imaging via the direct thermal printer 100 of FIG. 1. The particular layers of the coating 417 will be described in greater detail below with reference to FIG. 3C.

Figure 4B:
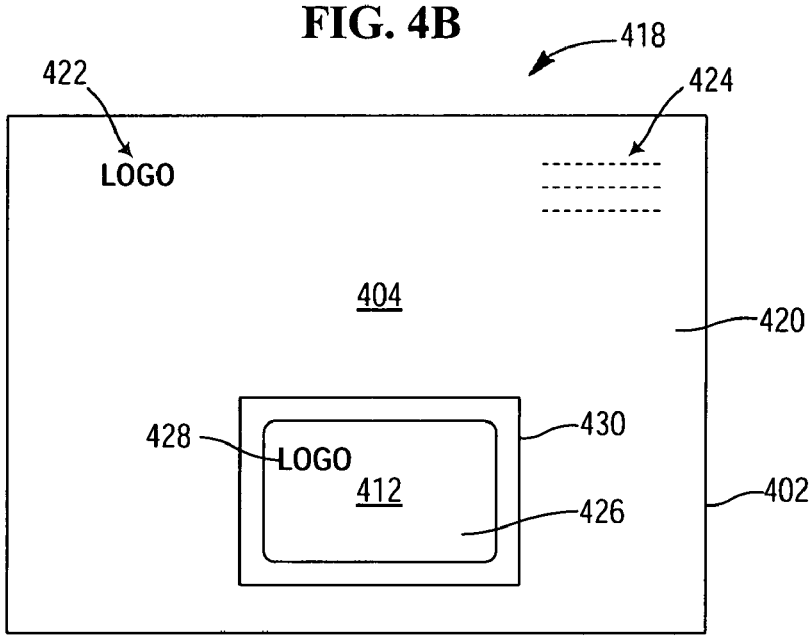
FIG. 4B illustrates an example second side of the form-card document in accordance with the third embodiment.

FIG. 4B illustrates an example second side 418 of the form-card document 402 in accordance with the third embodiment. The form 404 also includes a printing surface 420 on the second side 418 of the form-card document 402 for imaging graphics, text and/or combinations thereof. The printing surface 420 may also include pre-printed subject matter, including a logo 422 and other information 424, which may be disposed at predetermined locations of the form 404, as may be desired. The card 412 also includes a printing surface 426 on the second side 418 of the form-card document 402 for imaging graphics, text and/or combinations thereof. The printing surface 426 of the card 412 may also include pre-printed subject matter, including a logo 428 as well as any other information, which may be disposed at predetermined locations on the card 412. The second side 418 of the form-card 402 may also include a coating 430, which may include multiple layers and be disposed atop of and encompass the card 412 to protect the printing surface 426 from possible mechanical defacing, allow imaging of the printing surface 426 via the direct thermal printer 100 of FIG. 1. Elements 420-430 of form-card 402 are analogous to elements 220-230 of form-card 202 of FIG. 2B and therefore elements 420-430 will not be described in detail; instead the description of the analogous elements 220-230 is incorporated herein. The particular layers of the coating 430 will be described in greater detail below with reference to FIG. 3C.

Figure 4C:
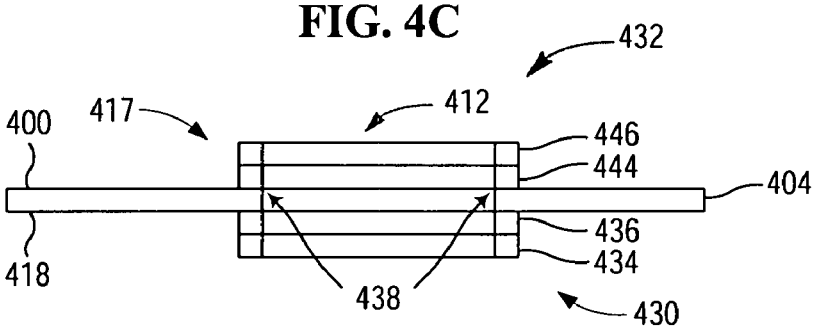
FIG. 4C illustrates an example cross-section of the example form-card document illustrated in FIGS. 4A-4B in accordance with the third embodiment.

FIG. 4C illustrates an example cross-section 432 of the example form-card document 402 illustrated in FIGS. 4A-4B above in accordance with the third embodiment. As illustrated, the coating 417 includes a laminate layer 446 adhered to the first side 400 of the form 404 via an adhesive layer 444.

Similarly, the coating 430 includes a laminate layer 434 adhered to the second side 418 of the form 404 via an adhesive layer 436. The adhesive layers 444, 336 that adhere respective laminate layers 446, 434 to the form 404 may use a hot melt adhesive process, a water-based adhesive process, a warm melt adhesive process that is cured via ultraviolet light and the like, as described above with respect to other embodiments. After the laminate layers 446, 434 are adhered via respective adhesive layers 444, 436, perforations 438 are provided through form 404, adhesive layers 444, 436 and the laminate layers 446, 434 to form the card 412 illustrated in FIGS. 4A-4B above. It is noted that the perforations 238 may be provided using die cutting techniques described herein.

Figure 5A:
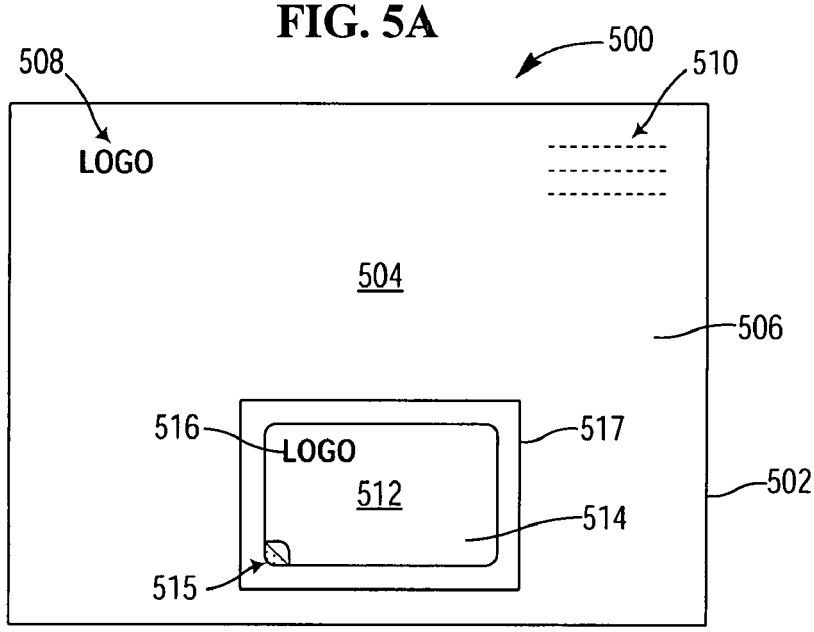
FIG. 5A illustrates an example first side of a form-card document that may be imaged using the example dual-sided imaging direct thermal printer in accordance with a fourth embodiment.

FIG. 5A illustrates an example first side 500 of a form-card document 502 that may be imaged using the example dual-sided imaging direct thermal printer 100 in accordance with a fourth embodiment. The form-card document 502 includes a form 504 and a card 512. The form 504 includes a printing surface 506 on the first side 500 of the form-card document 502 for imaging graphics, text and/or combinations thereof via the dual-sided imaging direct thermal printer 100 of FIG. 1. The printing surface 506 may further include pre-printed subject matter, including a logo 508 and other information 510. The card 512 also includes a printing surface 514 for imaging graphics, text and/or combinations thereof via the dual-sided imaging direct thermal printer 100 of FIG. 1. The printing surface 514 of the card 512 may also include pre-printed subject matter, including a logo 516 as well as any other information. As illustrated at 515 in FIG. 5A, the card 512 may also be adhered or secured to the form 504 by a clean release layer that would allow the user to easily separate the card 512 from the form 504, as will be described in greater detail in reference to FIG. 5C. The form-card 502 further includes a coating 517, which may include multiple layers and be disposed atop of and encompass the card 512. Elements 504-517 (except element 515) of form-card 502 are analogous to elements 404-417 of form-card 402 of FIG. 4A and therefore elements 504-517 will not be described in detail; instead the description of the analogous elements 404-417 is incorporated herein. Element 515 is analogous to element 315 of FIG. 3A and therefore will not be described; instead the description of the analogous elements 315 is incorporated herein The particular layers of the coating 517 will be described in greater detail below with reference to FIG. 5C.

Figure 5B:
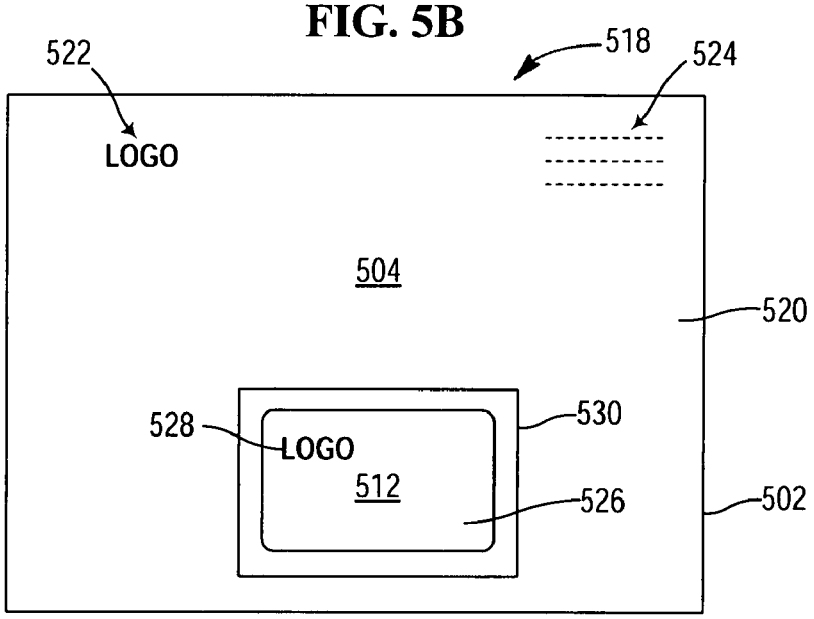
FIG. 5B illustrates an example second side of the form-card document in accordance with the fourth embodiment.

FIG. 5B illustrates an example second side 518 of the form-card document 502 in accordance with the fourth embodiment. The form 504 also includes a printing surface 520 on the second side 518 of the form-card document 502 for imaging graphics, text and/or combinations thereof. The printing surface 520 may also include pre-printed subject matter, including a logo 522 and other information 524, which may be disposed at predetermined locations of the form 504, as may be desired. The card 512 also includes a printing surface 526 on the second side 518 of the form-card document 502 for imaging graphics, text and/or combinations thereof. The printing surface 526 of the card 512 may also include pre-printed subject matter, including a logo 528 as well as any other information, which may be disposed at predetermined locations on the card 512. The second side 518 of the form-card 502 may also include a coating 530, which may include multiple layers and be disposed atop of and encompass the card 512. Elements 520-530 of form-card 502 are analogous to elements 420-430 of form-card 402 of FIG. 4B and therefore elements 520-530 will not be described in detail; instead the description of the analogous elements 420-430 is incorporated herein. The particular layers of the coating 430 will be described in greater detail below with reference to FIG. 5C.

Figure 5C:
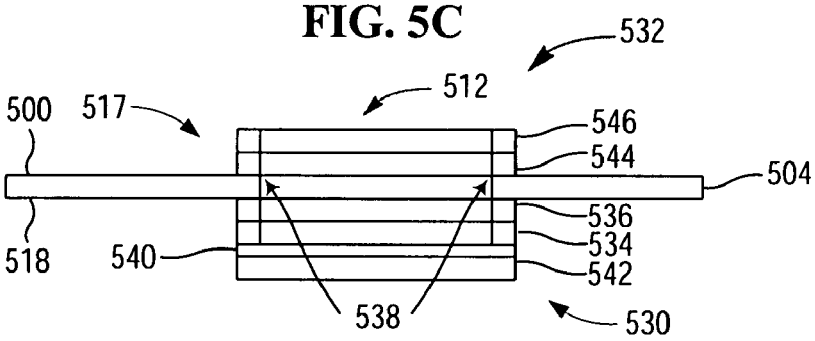
FIG. 5C illustrates an example cross-section of the example form-card document illustrated in FIGS. 5A-5B in accordance with the fourth embodiment.

FIG. 5C illustrates an example cross-section 532 of the example form-card document 502 illustrated in FIGS. 5A-5B above in accordance with the fourth embodiment. As illustrated, coating 517 includes a laminate layer 546 adhered to the first side 500 of the form 504 via an adhesive layer 544. Similarly, coating 530 includes a first laminate layer 534 adhered to the second side 518 of the form 504 via an adhesive layer 536. The coating 530 further includes a second laminate layer 542 that is adhered via a clean release layer 540 (e.g., varnish or other clean release bond agent) to the first laminate layer 534, allowing a user to easily separate the card 512 from the form 504. The adhesive layers 544, 536 that adhere respective laminate layers 546, 534 to the form 504 may use a hot melt adhesive process, a water-based adhesive process, a warm melt adhesive process that is cured via ultraviolet light and the like, as described above with respect to other embodiments. After the laminate layers 546, 534 are adhered via respective adhesive layers 544, 536, perforations 538 are provided through form 504, adhesive layers 544, 536 and the laminate layers 546, 534 to form the card 512 illustrated in FIGS. 5A-5B above. Alternatively to the perforations 538, complete die cut slits may be provided around card 512, as the clean release layer 540 provides sufficient adhesion of the first laminate layer 534 to the second laminate layer 542.

Figure 6A:
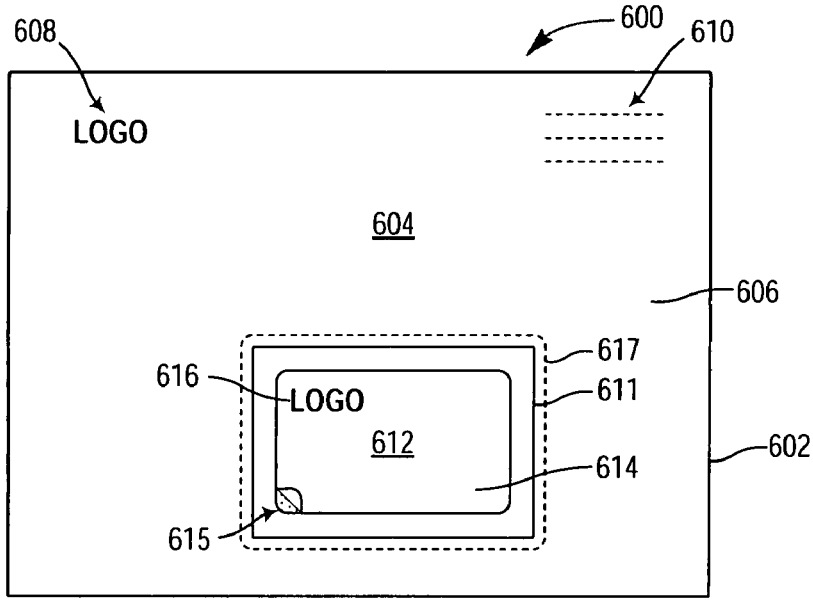
FIG. 6A illustrates an example first side of a form-card document that may be imaged using the example dual-sided imaging direct thermal printer in accordance with a fifth embodiment.

FIG. 6A illustrates an example first side 600 of a form-card document 602 that may be imaged using the example dual-sided imaging direct thermal printer 100 in accordance with a fifth embodiment. The form-card document 602 includes a form 604 and a card 612. The form 604 includes a printing surface 606 on the first side 600 of the form-card document 602 for imaging graphics, text and/or combinations thereof via the dual-sided imaging direct thermal printer 100 of FIG. 1. The printing surface 606 may further include pre-printed subject matter, including a logo 608 and other information 610. In the previous four embodiments, the card 212, 312, 412 and 512 was integral to and formed from the form 204, 304, 404 and 504. In the fifth embodiment, the card 612 is not integral to and not formed from the form 604, rather the card 612 is removably adhered to the form 604. More specifically, in some embodiments, the form 604 may include a depression or an embossing 617 into which a patch 611, from which card 612 is formed, is adhered. The patch 611 may be single-sided direct thermal print media. As illustrated at 615 in FIG. 6A, the patch 611 (from which card 612 is formed) is adhered or secured to the form 604 by a release layer (e.g., silicone, uv-curable silicone, and the like) that would allow the user to easily separate the card 612 from the form 604, as will be described in greater detail below with reference to FIG. 6C. The card 612 also includes a printing surface 614 for imaging graphics, text and/or combinations thereof via the dual-sided imaging direct thermal printer 100 of FIG. 1. The printing surface 614 of the card 612 may also include pre-printed subject matter, including a logo 616 as well as any other information.

Figure 6B:
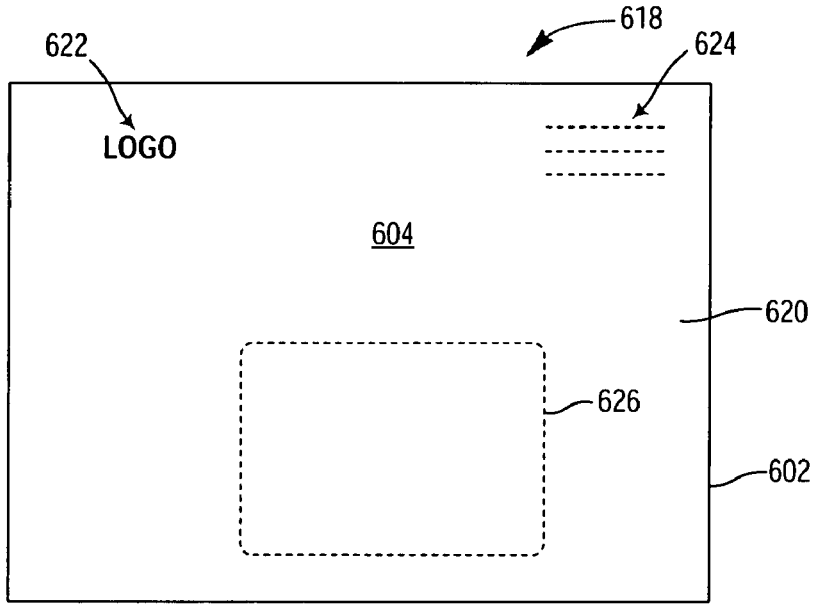
FIG. 6B illustrates an example second side of the form-card document in accordance with the fifth embodiment.

FIG. 6B illustrates an example second side 618 of the form-card document 602 in accordance with the fifth embodiment. The form 604 also includes a printing surface 620 on the second side 618 of the form-card document 602 for imaging graphics, text and/or combinations thereof The printing surface 620 may also include pre-printed subject matter, including a logo 622 and other information 624, which may be disposed at predetermined locations of the form 604, as may be desired. It is noted that the depression 617 on the first side 600 creates a respective raised surface or protrusion 626 on the second side 618, which will be illustrated in greater detail below with reference to FIG. 6C.

Figure 6C:
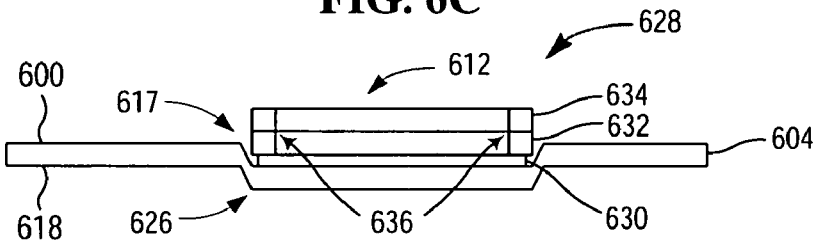
FIG. 6C illustrates an example cross-section of the example form-card document illustrated in FIGS. 2A-2B in accordance with the fifth embodiment.

FIG. 6C illustrates an example cross-section 628 of the example form-card document 602 illustrated in FIGS. 6A-6B above in accordance with the fifth embodiment. Patch 611, which includes single-sided thermal print media 634, is adhered into the depression 617 of the form 604 via a release layer 632 (e.g., silicone, uv-curable silicone, and the like) and an adhesive layer 630. Use of depression 617 decreases the protrusion of the patch 611 (FIG. 6A) above the form 604, to provide for a smooth transition among elements of the form card 602 for improved transport in and printing by the thermal printer 100 of FIG. 1. It is noted that certain combinations of thermal print media 634 and release layer 632 may require a coating (not shown) between the media 634 and the release layer 632. After the patch 611 is adhered to the form 604, perforations 636 are provided through media 634 and release layer 632 to form the card 612 from patch 611 illustrated in FIGS. 6A and 6C, facilitating ready removal of the card 612 by a user.

Figure 6D:
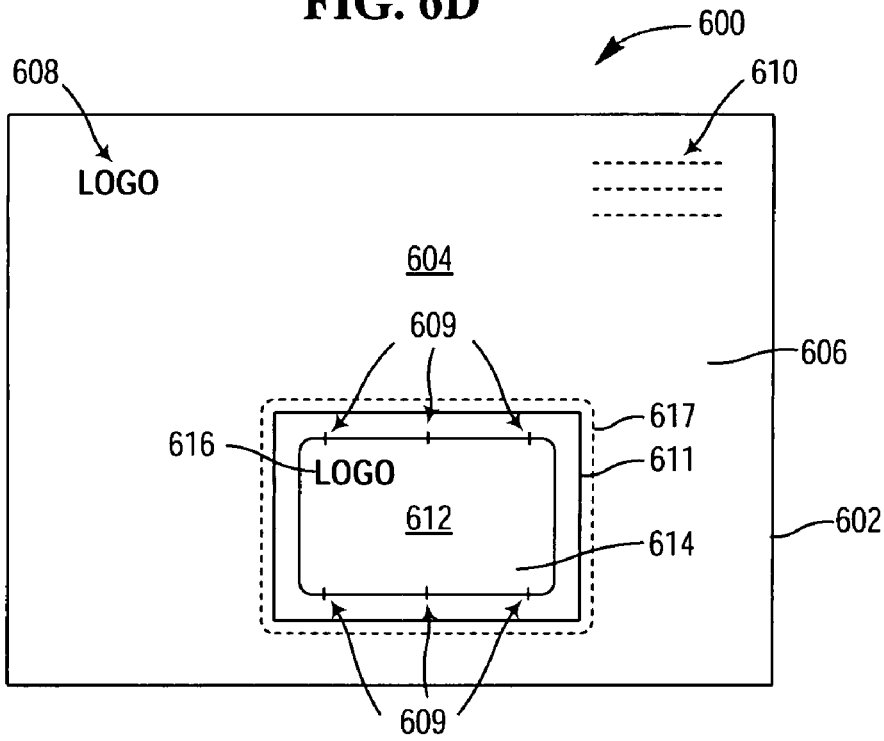
FIG. 6D illustrates example ties on the example first side of the form-card document in FIG. 6A adapted to secure the card to the patch.

FIG. 6D illustrates example ties 609 on the example first side 600 of a form-card document 602 in FIG. 6A adapted to secure the card 612 to the patch 611. Die cuts are provided around card 612, except for example ties 609 which are predetermined locations around card 612 that are not die cut. More specifically, in addition to the bond provided between the patch 611, the card 612 and the form 604 by the release layer 632 and the adhesive layer 630 (FIG. 6C), example ties 609 may be provided to enhance the bond between the patch 611 and the card 612.

Figure 6E:
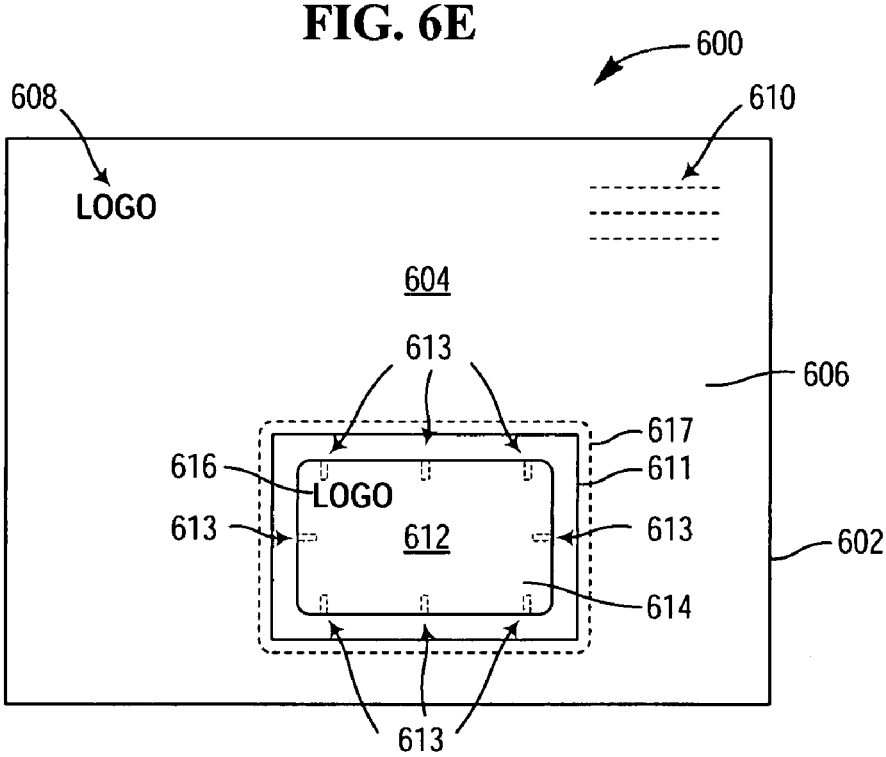
FIG. 6E illustrates example stealth ties on the example first side of the form-card document in FIG. 6A adapted to secure the card to the form.

FIG. 6E illustrates example stealth ties 613 on the example first side 600 of a form-card document 602 in FIG. 6A adapted to secure the card 612 to the form 604. More specifically, in addition to the bond provided between the patch 611, the card 612 and the form 604 by the release layer 632 and the adhesive layer 630 (FIG. 6C), stealth ties 613 may be provided to enhance the bond between form 604 and the card 612. Stealth ties 613 are formed by providing voids in the release layer 632 (FIG. 6C) about the edges of the card 612 to allow the adhesive layer 630 to penetrate through the skips in the release layer 632 to the card 612, bonding the card 612 to the form 604 at the voids.

Figure 7:
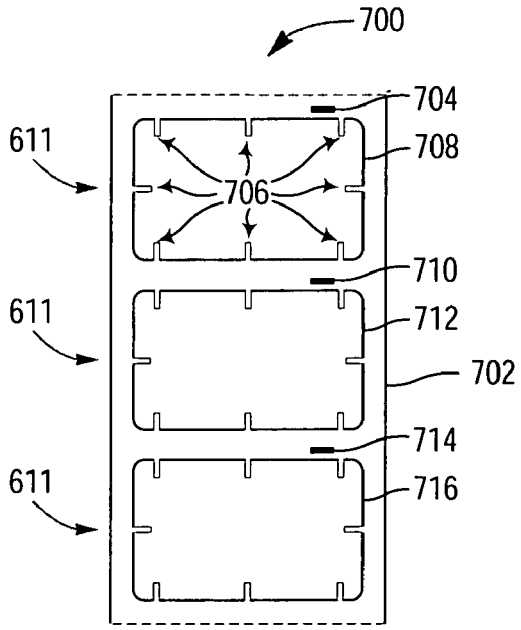
FIG. 7 illustrates an example backside of a web (or roll) of patches for producing form-card documents with stealth ties of FIG. 6E.

FIG. 7 illustrates an example backside 700 of a web (or roll) 702 of patches 611 for producing, inter alia, form-card documents 600 with stealth ties 613 of FIG. 6E. The roll 702 may comprise a single-sided direct thermal media with a printing surface (not shown) capable of being imaged by the printer 100 of FIG. 1 being on either the opposite (e.g., front) side or the example backside 700 thereof. Alternately, the roll 702 may comprise double-sided direct thermal media with printing surfaces capable of being imaged by the printer 100 of FIG. 1 on both the opposite (e.g., front) and the example backside 700. Each of the patches 611 of roll 702 includes a respective release layer 708, 712 and 716 (e.g., silicone, uv-curable silicone, and the like), which is adhered to the backside 700 of the roll 702 via, for example, a flexography press (not shown). Each respective release layer 708, 712 and 716 may include slits 706 to produce stealth ties 613 illustrated in FIG. 6E. The flexography press also prints registrations marks 704, 710 and 714 above each respective patch 611, enabling the respective patches 611 to be cut from the web 702 during formation of the form-card documents 600, as will be described in greater detail below with reference to FIG. 8. It is noted that slits 706 may be omitted from the release layer 708, 712, 716 in the formation of roll 702 to allow formation of, inter alia, form-card documents 600 illustrated in FIGS. 6A and 6D above. Further one or both sides of the web 702 may be thermally imaged or otherwise printed prior to formation of a form-card document 600. In such a case, the registration marks 704, 710 and 714 may be used to align single- or double-sided thermal or other printing in a particular region of the web 702 such as on a particular patch and/or card portion thereof.

Figure 8:
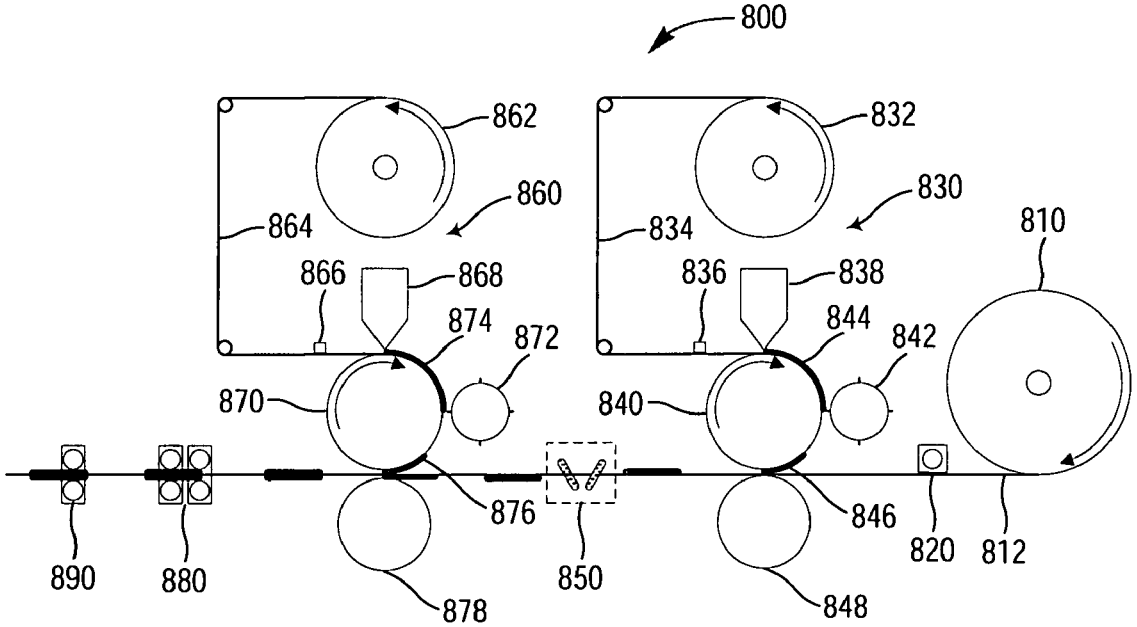
FIG. 8 is an example form-card system for forming form-card documents in accordance with FIGS. 2A-6E.

FIG. 8 is an example form-card system 800 for forming form-card documents in accordance with FIGS. 2A-6E. The form-card system 800 includes a roll 810 of dual-sided thermal print media 812 which is unrolled from roll 810 and from which the form portion of the form-card is formed. Form-card system 800 may include an embossing station 820 which embosses the thermal print media 812 to form, for example, a depression 617 of FIGS. 6B-6C. Alternatively, the roll 810 may already contain embossed thermal print media 812. The form-card system 800 may further include assemblies 830, 850, 860, 880 and 890 for generating the various form-card documents of FIGS. 2A-6E. Depending on the particular form-card document of FIGS. 2A-6E, one assembly 830 or both assemblies 830, 860 and turn-bar assembly 850 may be provided. Alternatively, all assemblies may be provided in system 800, but assemblies 830, 850 and 860 may not be used for generating certain form-card documents of embodiments in FIGS. 2A-6E.

Further with reference to FIG. 8, assembly 830 includes a roll 832 of particular material 834 as will be described below. The material 834 is unrolled from the roll 832 and pulled toward adhesive dispenser 838 which applies adhesive 844 to the material 834. A sensor 836 may be disposed before the adhesive dispenser 838 to detect registration marks. A cutoff device 842 cuts the material 834 to appropriate length 846 and the material 834 of length 846 is applied to a first side of the print media 812, which is then pulled through (sandwiched between) rollers 840 and 848 to adhere the cut material 834 to print media 812. Rollers 840 and 848 apply pressure to adhere the cut material 834 to the print media 812. The adhesive dispenser 838 and the cutoff device 842 may, but need not, perform their respective operations based on detected registration marks on the material 834. After print media 812 passes through rollers 840, 848 of assembly 830, turn-bar assembly 850 may turn the print media 812 from the first side to a second side. In alternate embodiments, the cutoff device 842 may be placed upstream of the adhesive dispenser 838 to cut the media 834 to a desired length 846 prior to application of the adhesive 844.

Further with reference to FIG. 8, assembly 860 includes a roll 862 of particular material 864 as will be described below. The material 864 is unrolled from the roll 862 and pulled toward adhesive dispenser 868 which applies adhesive 874 to the material 864. A sensor 866 may be disposed before the adhesive dispenser 868 to detect registration marks. A cutoff device 872 cuts the material 864 to appropriate length 876 and the material 864 of length 876 is applied to a second side of the print media 812, which is then pulled through (sandwiched between) rollers 870 and 878 to adhere the cut material 874 to print media 812. Rollers 870 and 878 of assembly 860 apply pressure as described above in reference to rollers 840, 848 of assembly 830. The adhesive dispenser 868 and the cutoff device 872 may, but need not, perform their respective operations based on detected registration marks on the material 864. In alternate embodiments, the cutoff device 872 may be placed upstream of the adhesive dispenser 868 to cut the media 864 to a desired length 876 prior to application of the adhesive 874.

Still further with reference to FIG. 8, after the print media 812 passes through rollers 876, 878 of assembly 860, the print media 812 is advanced to a perforation/die cut assembly 880, which may form the particular perforations and/or die cuts shown in the various form-cards of embodiments in FIGS. 2A-6E. At this point the print media includes form-cards in accordance with any of the embodiments in FIGS. 2A-6E. Thereafter, a sheeter assembly 890 may be provided to cut the print media into individual form-card sheet stock. Alternatively, the print media 812, which includes plural form-cards, may be rolled into a roll (not shown) similar to roll 810 for further processing, printing or distribution.

Still further with reference to FIG. 8, the formation of the various form-card embodiments of FIGS. 2A-6E will be described in greater detail. To form the first embodiment (FIGS. 2A-2C), assembly 830 may include roll 832 of laminate material to be adhered or applied to the print media 812 with appropriate adhesive 844 dispensed from adhesive dispenser 838. Assemblies 850, 860 may be omitted from form-card system 800 or may be simply not used to generate the form-card document of FIGS. 2A-2C. To form the second embodiment (FIGS. 3A-3C), assembly 830 may include roll 832 of laminate material having a first laminate layer separated by a clean release layer from a second laminate layer, to be adhered or applied to the print media 812 with appropriate adhesive 844 dispensed from adhesive dispenser 838. Again, assemblies 850, 860 may be omitted from form-card system 800 or may be simply not used to generate the form-card document of FIGS. 3A-3C.

Yet further with reference to FIG. 8, to form the third embodiment (FIGS. 4A-4C), assembly 830 may include roll 832 of laminate material to be adhered or applied to a first side of print media 812 with appropriate adhesive 844 dispensed from adhesive dispenser 838, and assembly 860 may also include roll 862 of laminate material to be adhered or applied to a second side of print media 812 with appropriate adhesive 874 dispensed from adhesive dispenser 868. To form the fourth embodiment (FIGS. 5A-5C), assembly 830 may include roll 832 of laminate material to be adhered or applied to a first side of print media 812 with appropriate adhesive 844 dispensed from adhesive dispenser 838, and assembly 860 may also include roll 862 of laminate material having a first laminate layer separated by a clean release layer from a second laminate layer, to be adhered or applied to a second side of the print media 812 with appropriate adhesive 874 dispensed from adhesive dispenser 868. The order of the application of the single-layer laminate and the double-layer laminate may be reversed between assemblies 830, 860, as may be desired.

Lastly with reference to FIG. 8, to form the fifth embodiment (FIGS. 6A-6E), assembly 830 may include roll 832 of patch 611 of FIG. 7 to be adhered or applied to the print media 812 with appropriate adhesive 844 dispensed from adhesive dispenser 838. Print media 812 may include depressions 617 into which patches 611 will be adhered via assembly 830. As noted before, slits 706 in respective patches 611 may be included (or omitted) to provide stealth ties 613 (FIG. 6E). Assemblies 850, 860 may be omitted from form-card system 800 or may be simply not used to generate the form-card document of FIGS. 6A-6E. Sensor 836 may detect the respective registration marks 704, 710 and 714 to activate the adhesive dispenser 838 and the cutoff device 842.

Figure 9:
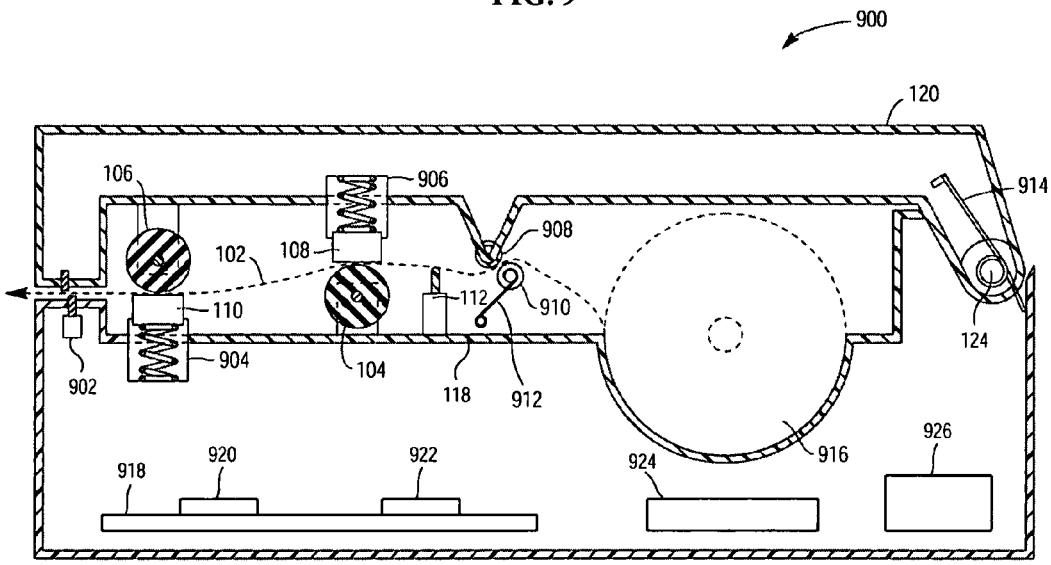
FIG. 9. illustrates a schematic of a partial centerline elevation view of an example dual-sided imaging direct thermal printer in accordance with FIG. 1 adapted to image form-card documents of FIGS. 2A-6E.

FIG. 9. illustrates a schematic 900 of a partial centerline elevation view of an example dual-sided imaging direct thermal printer 100 in accordance with FIG. 1 adapted to image form-card documents of FIGS. 2A-6E. Thermal printer 100 includes first print head 110, first platen 104, sensor 112 and first guide roller 910, all being coupled to a support arm 118 and all being on a first side of the thermal print media 102. The position of the sensor 112 may be determined based on design requirements of the thermal printer 100 and thermal media 20 (various form-card embodiments of FIGS. 2A-6E). It is noted that the feed path of thermal print media 102 is shown by dashed lines of and an arrow at one end of the thermal print media 102. It is further noted that thermal print media 102 may be drawn from a continuous thermal print media roll 916 housed in the interior of the thermal printer 100 between the first support arm 118 and the second support arm 120. It is to be noted that the continuous thermal print media roll 916 may easily be substituted with a continuous fan-folded print media stack or cut sheet stock, similarly housed in the interior of the thermal printer 100. Likewise, in alternate embodiments, any or all of the continuous thermal print media roll 916, continuous fan-folded print media stack or cut sheet stock may be housed or otherwise supported on the exterior of the thermal printer 100.

As illustrated in FIG. 9, the thermal printer 100 further includes a second print head 108, second platen 106 and second guide roller 908, all being coupled to pivotable support arm 120 and all being on a second (reverse) side of the thermal print media 102. The pivotable support arm 120 pivots about the arm shaft (or hinge) 124 to allow replacement of the thermal print media 102 and servicing of the thermal printer 100. When pivotable support arm 120 is closed in relation to support arm 118, the thermal print media 102 may be engaged between first print head 110 and opposed second platen 106, between second print head 108 and opposed first platen 104, and between first guide roller 910 and opposed second guide roller 908. Contact pressure with and tension of the thermal print media 102 may be maintained by spring loading second print head 108, first print head 110, and/or first guide roller 910 with spring mechanisms 906, 904 and 912, respectively. The thermal printer 100 also includes spring 914 that enables the pivotable arm 120 to open at a controlled rate in relation to arm 118, and thereby avoid, for example, uncontrolled closing of the arm 120 through force exerted on the arm 120 via the acceleration of gravity. The thermal printer may also include an electronically activated mechanical cutting mechanism 902 to detach the thermal print media 102 upon completion of a print operation, such as the printing of a form-card document of FIGS. 2A-6E.

With further reference to FIG. 9, it is noted that the print heads 108 and 110 are substantially in-line and face substantially opposed directions. As a result, the feed path of thermal print media 102 may be substantially a straight line path given the substantially in-line orientation of the print heads 108 and 110. This configuration facilitates frontal exiting of the thermal print media 102 from the thermal printer. The in-line feed path also facilitates automation of thermal print media 102 replacement and feed, which includes allowing the thermal print media 102 to be automatically drawn from the first print head 108 and second platen 104 through the second print head 110 and first platen 106. Although the in-line orientation of print heads 108 and 110 is described, alternate orientations of the first head 108 in respect to the second print head 110, including varied angle orientations (e.g., 45, 90, 135 and 180 degrees), are possible based on particular design requirements of the thermal printer 10, thermal print media 20 and/or desired media feed path.

Still with further reference to FIG. 9, the thermal printer 100 also includes control electronics for controlling the operation of the thermal printer. The control electronics may include a motherboard 918, a microprocessor or central processing unit (CPU) 920, and memory 922, such as one or more dynamic random access memory (DRAM) and/or non-volatile random access memory (NVRAM) print buffer memory elements. The thermal printer 100 further includes a communications controller 924 for communicating with one or more host or auxiliary systems, such as a point-of sale terminal (POS) or a computer for input of data to and output of data from the thermal printer 100. Communications controller 924 may support universal serial bus (USB), Ethernet and or wireless communications, among others. The data for printing would typically be supplied by a host POS terminal or a computer communicating with the thermal printer 100 via the communication controller 924.

Lastly with reference to FIG. 9, memory 922 of the dual-sided direct thermal printer 100 may have a predefined print data storage area to store one or more blocks of predefined print data to be repetitively printed on one or both sides of the print media 102. The blocks of predefined print data may include, for example, a store identifier, a logo, other information, and the like. Thus, the blocks of predefined print data may include the logo and other information identified in FIGS. 2A-6E above. Additional information not expressly enumerated may also be included in blocks of predefined print data. The predefined print data may be printed along with data submitted by application software associated with the POS terminal or computer on the same or the opposite media side of thermal print media 20. Where multiple data blocks are stored in the predefined print data storage area, the blocks may be alternatively selected for printing through use of a hardware or software switch 926, as may be the location or side of the media on which they, along with data submitted by application software associated with the POS terminal or computer, are printed, and the like.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the description. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

What is claimed is:

1. A form-card comprising:

a dual-sided thermal form including a first side and a second side; and a dual-sided thermal card being integral with the form and detachable therefrom, wherein the form is adapted to be thermally imaged from a first side and a second side of the form and the card is adapted to be thermally imaged from a first side and a second side of the card.

2. The form-card of claim 1, wherein the form-card is perforated or die cut to form the card.

3. The form-card of claim 1, further comprising a coating, wherein at least a first portion of the coating is included on the second side of the form and at least a second portion of the coating is included on the second side of the card.

4. The form-card of claim 3, further comprising:

a laminate layer;

wherein the coating includes an adhesive layer and the laminate layer is adhered to the second side of the card by the adhesive layer.

5. The form-card of claim 4, wherein the dual-sided thermal card is formed by perforations or die cuts through the form, the laminate layer and the adhesive layer.

6. The form-card of claim 4, further comprising another coating, wherein at least a first portion of the other coating is included on the first side of the form and at least a second portion of the other coating is included on the first side of the card.

7. The form-card of claim 6, further comprising:

another laminate layer;

wherein the other coating includes another adhesive layer and the other laminate layer is adhered to the first side of the card by the other adhesive layer.

8. The form-card of claim 7, wherein the dual-sided thermal card is further formed by perforations or die cuts through the form, the one laminate layer, the one adhesive layer the other laminate layer, and the other adhesive layer.

9. The form-card of claim 3, further comprising:

a first laminate layer;

wherein the coating includes an adhesive layer and the first laminate layer is adhered to the second side of the card by the adhesive layer;

a second laminate layer; and a clean release layer between the first laminate layer and the second laminate layer.

10. The form-card of claim 9, wherein the dual-sided thermal card is formed by perforations or die cuts through the form, the first laminate layer and the adhesive layer.

11. The form-card of claim 9, further comprising a another coating, wherein at least a first portion of the other coating is included on the first side of the form and at least a second portion of the other coating is included on the first side of the card.

12. The form-card of claim 11, further comprising:

a third laminate layer;

wherein the other coating includes another adhesive layer and the third laminate layer is adhered to the first side of the card by the other adhesive layer.

13. The form-card of claim 12, wherein the dual-sided thermal card is further formed by perforations or die cuts through the form, the first laminate layer, the one adhesive layer, the third laminate layer, and the other adhesive layer.

* * * * *